United States Patent [19]

Husain et al.

[11] 4,397,608

[45] Aug. 9, 1983

[54] ENERGY-ABSORBING TURBINE MISSILE SHIELD

[75] Inventors: Iqbal Husain, Brookfield Center; Arnold Gundersen, New Fairfield; John F. Risley, Roxbury, all of Conn.

[73] Assignee: Automation Industries, Inc., Greenwich, Conn.

[21] Appl. No.: 145,507

[22] Filed: May 1, 1980

[51] Int. Cl.[3] ..... F01D 25/24

[52] U.S. Cl. ..... 415/9; 415/121 G; 415/219 R

[58] Field of Search ..... 415/9, 219 R, 121 G; 52/86, 90; 74/609; 89/36 R, 36 A, 36 C, 36 Z

[56] References Cited

U.S. PATENT DOCUMENTS

| | | | |
|---|---|---|---|
| 1,447,966 | 3/1923 | Davidson | 89/36 C |
| 1,698,514 | 1/1929 | Schmidt | 415/9 |
| 1,971,658 | 8/1934 | Ridley | 52/90 X |
| 2,095,128 | 10/1937 | Dorain | 415/219 R X |
| 2,390,418 | 12/1945 | Brown | 52/86 |
| 2,407,252 | 9/1946 | Closs | 52/86 |
| 3,381,432 | 5/1968 | Brandwein | 52/86 X |
| 3,405,496 | 10/1968 | Van der Meer | 52/86 X |
| 3,630,635 | 12/1971 | Fatum | 415/219 R |
| 3,936,219 | 2/1976 | Holmes | 415/9 X |
| 3,974,313 | 8/1976 | James | 415/9 X |
| 4,057,359 | 11/1977 | Grooman | 415/9 |

FOREIGN PATENT DOCUMENTS

| | | | |
|---|---|---|---|
| 484435 | 10/1929 | Fed. Rep. of Germany | 52/86 |
| 1241380 | 11/1959 | France | 52/86 |
| 343079 | 4/1936 | Italy | 52/86 |

*Primary Examiner*—Leonard E. Smith

*Attorney, Agent, or Firm*—Francis N. Carten

[57] ABSTRACT

A turbine missile shield is formed by a series of substantially semi-cylindrical, concentric stainless steel shells joined and spaced apart by longitudinal and transverse spreader beams. The longitudinal peripheries of the shells are joined to form mounting rims with bolt holes formed therein to enable mounting on a turbine pedestal or operating floor.

3 Claims, 5 Drawing Figures

Fig. 3.
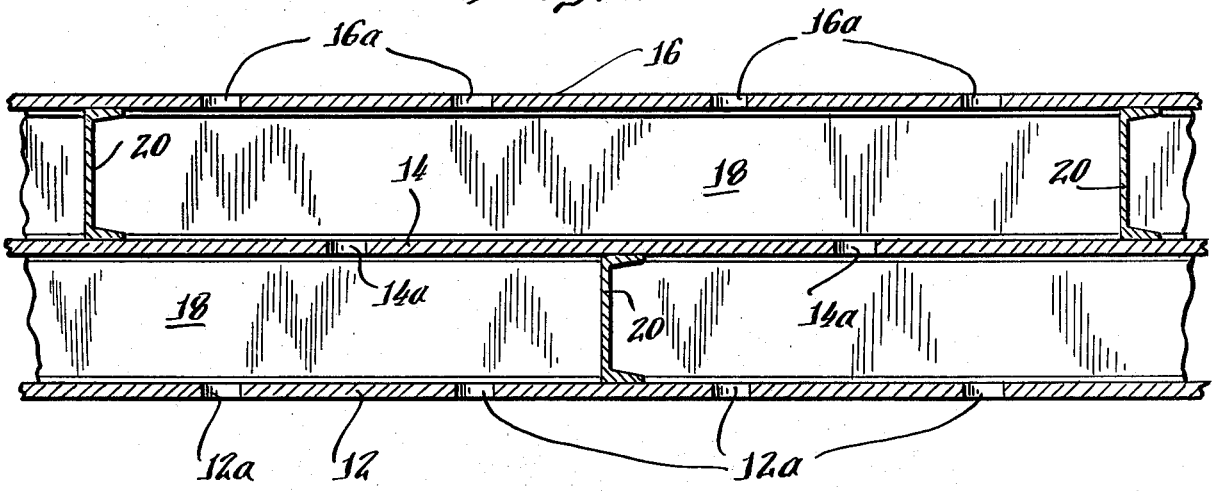
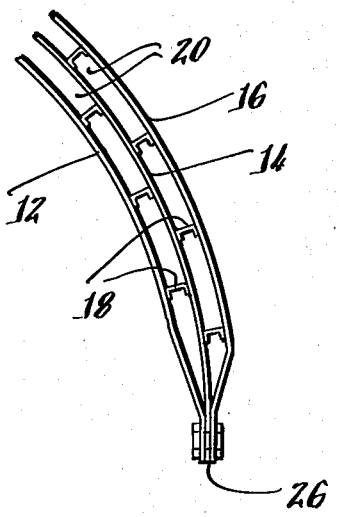
Fig. 4.
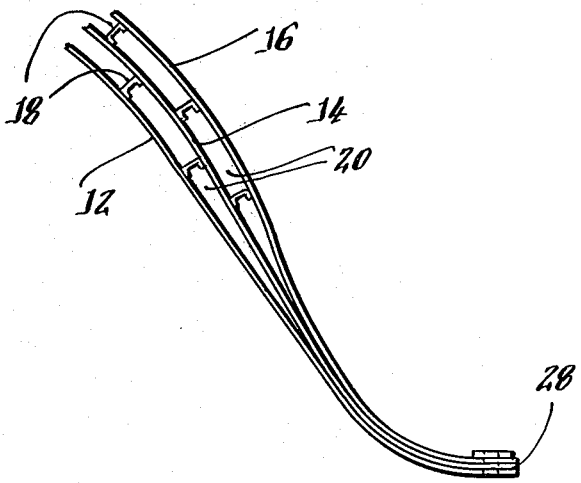
Fig. 5.

ENERGY-ABSORBING TURBINE MISSILE SHIELD

BRIEF SUMMARY OF THE INVENTION

The present invention is embodied in and carried out by a shield structure to be fitted over the outer casing of a turbine, or to replace that outer casing. The shield is preferably of the same general shape as the outer casing of the turbine, and is formed by a number of overlapping shells. Each shell is connected to and spaced away from the adjacent shell (or shells) by longitudinal and transverse spreader beams. Each spreader beam is preferably positioned midway between the nearest, similarly-oriented spreader beams on the opposite side of the shell (or shells) to which each spreader beam is connected in order to employ the ductility of the shells and the spreader beams to optimum effect in absorbing the energy of turbine missiles. The shield is attached to the turbine pedestal or operating floor through bolt holes in the mounting rims which are formed by the joined edges of the shells.

BRIEF DESCRIPTION OF THE DRAWINGS

The present invention will be better understood if the written description thereof is read with reference to the accompanying drawings, of which:

FIG. 3 is sectional view of said turbine missile shield taken along line 3—3 in FIG. 2;

FIG. 4 shows a first alternative form of mounting connection; and

FIG. 5 shows a second alternative form of mounting connection.

DETAILED DESCRIPTION

Turbine missiles consist of broken pieces of the disks that connect the blades to the rotor, or broken pieces of the blades themselves, or broken pieces of the ring connecting the outer tips of the blades in some turbines. Materal imperfections, or other manufacturing flaws, or stress corrosion cracking coupled with high centripetal forces acting on the turbine's internal parts results in missiles which may penetrate the turbine casing to possibly impinge upon power plant components or personnel.

Turbine missile shields of any type have rarely been used in the past. There is only one known case of a structure being erected for the specific purpose of shielding turbine missiles. This structure was formed of concrete, and suffered from numerous disadvantages. First, concrete breaks up and forms secondary missiles when struck by a turbine missile. Second, concrete acts as a deflector of turbine missiles because it does not have good energy-absorbing properties. Thus, turbine missiles lose only a small part of their kinetic energy in the localized crushing of a concrete shield, and therefore retain the potential to cause severe damage. Third, it is a very difficult analytical problem to determine the amounts of energy that will be absorbed by a concrete shield. The performance data of any specific form of concrete shield must, as a practical matter, be determined empirically. Fourth, a concrete shield is very heavy and therefore difficult to move when turbine maintenance must be performed. The great weight of a concrete shield necessitates extra structural supports beneath the operating floor, thereby increasing plant construction costs. It is the purpose of the present invention to provide a turbine missile shield having none of these disadvantages.

Figure 1:
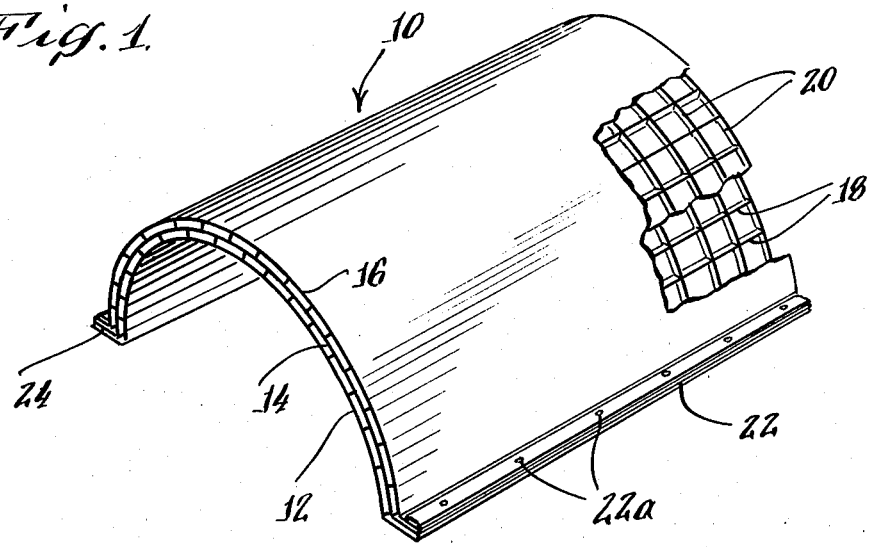
FIG. 1 is a perspective view of the preferred embodiment of applicants' turbine missile shield.
Figure 2:
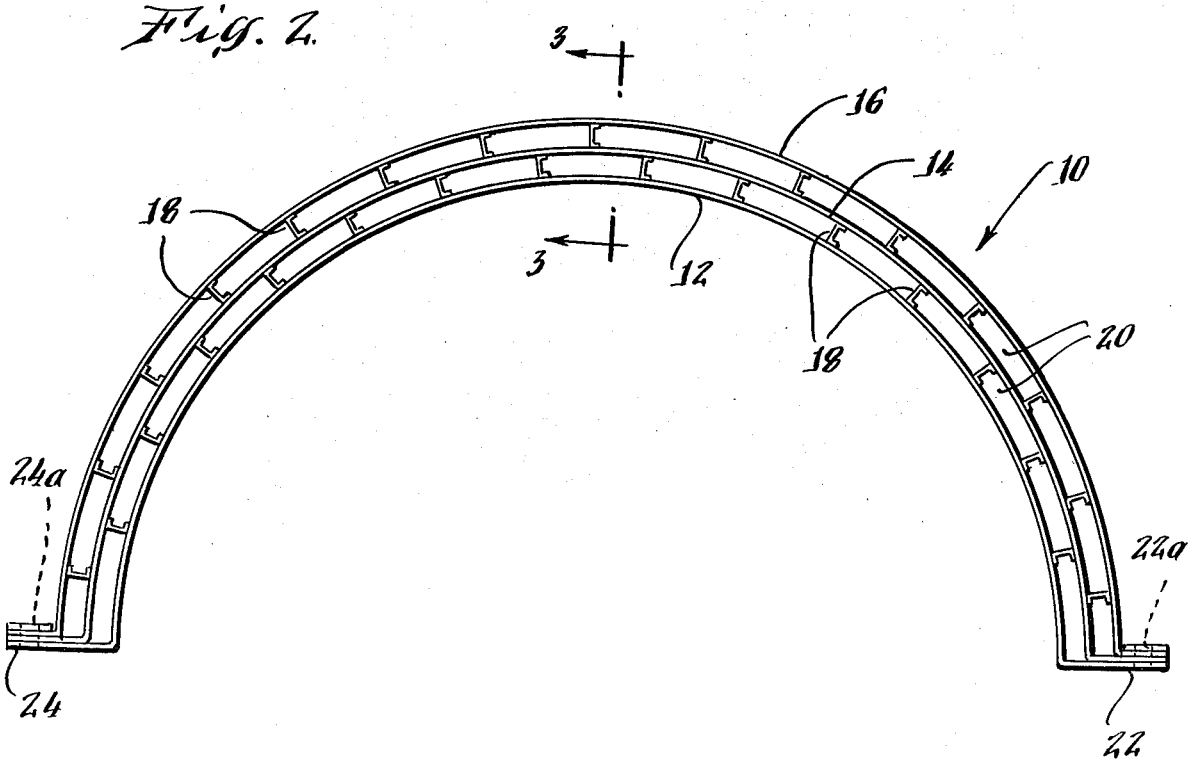
FIG. 2 is an end view of said turbine missile shield taken along line 2—2 in FIG. 1.

Referring now to the drawings, the turbine missile shield 10 shown in FIGS. 1–2 comprises a series of substantially concentric, semi-cylindrical shells 12, 14 and 16 made of a ductile material such as stainless steel.

Longitudinal spreader beams 18 and transverse spreader beams 20 formed from either stainless steel or carbon steel serve to connect the inner shell 12 to the central shell 14, and to connect the central shell 14 to the outer shell 16. The spreader beams 18, 20 are continuously or intermittently connected to shells 12, 14, 16 by welds or bolts, for example. Mounting rims 22 and 24 are formed along the longitudinal peripheries of shells 12, 14 and 16 by bending the shells so as to make them contiguous, and by welding them together, preferably with one or more reinforcing strips. A series of bolt holes **22*a* and 24*a* are formed in the mounting rims 22 and 24, preferably so as to enable the shield 10** to be mounted on the operating floor or turbine pedestal by means of the turbine flange bolts which secure the turbine casing.

It will be seen in FIGS. 1–4 that each of the longitudinal spreader beams 18 which connects the outer and central shells 16 and 14 is spaced about midway between the nearest longitudinal spreader beams 18 which connect the central and inner shells 14 and 12. Similarly, each of the transverse spreader beams 20 which connects the outer and central shells 16 and 14 is spaced about midway between the nearest transverse spreader beams 20 which connect the central and inner shells 14 and 12. This structural feature enables the ductility of the shells 12, 14, 16 to be employed to optimum effect in absorbing the energy of turbine missiles. As a missile strikes the inner shell 12, the spreader beams 18, 20 transmit the impact to the central and outer shells 14 and 16. Transverse reactive forces are thus created in all of the shells 12, 14, 16 and are widely distributed therethrough to the mounting rims 22,24. The spreader beams 18, 20 space the inner shell 12 from central shell 14, and the central shell 14 from outer shell 16. Thus, a missile has to impact against the inner shell 12 and then move through or against it across the intervening space before impacting the central shell 14, and then must move through or against that shell across the intervening space before impacting the outer shell 16. Consequently, there can be no simultaneous piercing of the shells 12, 14, 16 by the missile, and the amount of translational kinetic energy absorbed by elastic-plastic deformation of the shells by the missile is maximized.

The stress vs. strain curve for the shell material and the circumferential length of the shield establishes the thickness of the concentric shells 12, 14, 16 required to achieve a specific level of energy absorption. Because it is ductile in both the elastic and plastic ranges, a stainless steel such as Type 304 is the preferred shell material. An analysis of the stress/strain and energy absorption characteristics of this material follows.

Dynamic tensile test data relates strain energy per unit volume of material to the total strain $\epsilon_t$ in the plastic, high-strain region of the stress vs. strain curve. To construct the dynamic stress/strain relationship, it may be assumed that $$\sigma = K\dot{\epsilon}^n \quad (1)$$

$\sigma$=stress (pounds per square inch)

K=a first parameter empirically derived from the dynamic stress vs. strain curve for the shell material $\epsilon$=strain (inches per inch)

n=a second dimensionless parameter empirically derived from the dynamic stress vs. strain curve for the shell material Internal strain energy E per unit volume is determined by the formulae $$E = \int_0^{\epsilon_t} \sigma d\epsilon \quad (2)$$

$$E = K \int_0^{\epsilon_t} \epsilon^n d\epsilon \quad (3)$$

$$E = \frac{K}{n+1} \epsilon_t^{n+1} \quad (4)$$

By plotting the data E vs. $\epsilon_t$ on a log-log scale and fitting a straight line to that data, the exponent n+1 is readily determined.

With formula (4) above, it is now possible to calculate the resulting deformation of the shells 12, 14, 16 and the reaction load generated during a missile impact by using energy balance methods. By equating the external kinetic energy of the missile to the internal strain energy of the shells, the maximum strain, deformation, stress and reaction loads can be obtained. The total volume $V_t$ of the shells is first determined by the formula $$V_t = (\pi R_{12} t_{12} + \pi R_{14} t_{14} + \pi R_{16} t_{16})L, \quad (5)$$

where $R_{12}$, $R_{14}$ and $R_{16}$=the effective radii of shells 12, 14 and 16, respectively, and $t_{12}$, $t_{14}$ and $t_{16}$=the thicknesses of shells 12, 14, and 16, respectively, and L is that portion of longitudinal length of the shells 12, 14 and 16 which is effective in absorbing missile energy. To determine the total internal strain energy $E_t$ for the shield 10, the the formulae (4) and (5) are combined:

$$E_t = \frac{K}{n+1} \epsilon^{n+1} [(\pi R_{12} t_{12} + \pi R_{14} t_{14} + \pi R_{16} t_{16})L] \quad (6)$$

It is assumed in formula (6) that the same state of strain exists in all of the shells in shield 10. An estimate of the external kinetic energy $E_x$ of the missile may be made on the basis of findings in the publication entitled "Likelihood And Consequences of Turbine Overspeed At The Indian Point Nuclear Generating Unit No. 2" by J. N. Fox, Westinghouse Electric Corporation, Nuclear Energy Systems, July 1970. By making the equation:

$$E_x = E_t \quad (7)$$

the unknown maximum strain $\epsilon$ may be determined. The maximum deformation $\Delta L$ of each shell may be calculated by the formula $$\Delta L = \epsilon R \pi \quad (8)$$

where R is the effective radius of the shell under consideration. The maximum stress $\sigma$ may be calculated by formula (1) above. The maximum reaction load F may then be calculated with the formula $$F = \sigma L(t_{12} + t_{14} + t_{16}) \quad (9)$$

Referring now specifically to FIG. 3, this transverse cross-sectional view also shows optional ventilating holes 12*a*, 14*a* and 16*a* in shells 12, 14 and 16, respectively. These ventilating holes can be positioned so as to have no material adverse effect on the energy-absorbing capability of shield 10. Lifting hooks or eyes may also be attached to the exterior of the shield 10 to enable it to be lifted from the turbine by a crane or pulley. Modified forms of the mounting rims are shown in FIGS. 4 and 5. In FIG. 4, a vertical mounting rim 26 is formed by joining the edges of shells 12, 14 and 16 with inner and outer reinforcing strips. In FIG. 5, another horizontal mounting rim 28 is formed by gradually curving the edges of shells 12, 14 and 16 together and joining them with an upper reinforcing strip. The number of shells employed may vary from two to as many as analysis indicates are required. The spreader beams may be varied in spacing and orientation relative to one another, in dimensions, and in orientation relative to the shells.

The advantages of the present invention, as well as certain changes and modifications to the disclosed embodiment thereof, will be readily apparent to those skilled in the art. It is the applicants' intention to cover all those changes and modifications which could be made to the embodiment of the invention herein chosen for the purposes of the disclosure without departing from the spirit and scope of the invention.

We claim:

1. An energy-absorbing turbine missile shield for containing any broken pieces of rotatable parts of a turbine thrown outwardly through a turbine casing with substantial kinetic energy comprising:

(a) at least two rigid spaced concentric curved shells enclosing the turbine casing and formed of ductile stainless steel deformable plastically as well as elastically under impact of said broken turbine pieces to absorb their kinetic energy without resulting in complete penetration through both of said shells;

(b) a plurality of longitudinal spreader beams of ductile metal connecting and spacing apart the two shells; and (c) a pair of opposed mounting rims formed by opposed edges of at least one of said shells to permit mechanical attachment of the shield with respect to a fixed operating floor.

2. An energy-absorbing turbine missile shield according to claim 1 wherein the ductile stainless steel is Type 304 stainless.

3. An energy-absorbing turbine missile shield according to claim 1 wherein each of said mounting rims is formed by opposed overlapping edges of the shells, each rim having a series of bolt holes formed therein.

* * * * *